United States Patent [19]

de Koning

[11] 4,123,859

[45] Nov. 7, 1978

[54] SHOCK ABSORBING SYSTEM FOR SUCTION DREDGERS

[75] Inventor: Jan de Koning, Amsterdam, Netherlands

[73] Assignee: Ballast-Nedam Groep N.V., Amstelveen, Netherlands

[21] Appl. No.: 717,495

[22] Filed: Aug. 25, 1976

[30] Foreign Application Priority Data

Aug. 25, 1975 [NL] Netherlands ..... 7510028

[51] Int. Cl.[2] ..... E02F 3/88

[52] U.S. Cl. ..... 37/58; 172/265; 172/705; 188/282

[58] Field of Search ..... 37/58, 61–63; 172/265, 264, 705; 188/282

[56] References Cited

U.S. PATENT DOCUMENTS

| | | | |
|---|---|---|---|
| 1,457,122 | 5/1923 | Ree | 188/282 |
| 1,543,098 | 6/1925 | Carter et al. | 188/282 |
| 1,840,606 | 1/1932 | Scheffauer | 37/58 |
| 3,760,882 | 9/1973 | Geurts | 172/265 |
| 3,814,219 | 6/1974 | Fannin et al. | 188/282 |

FOREIGN PATENT DOCUMENTS

| | | | |
|---|---|---|---|
| 971,580 | 7/1975 | Canada | 37/58 |

*Primary Examiner*—Clifford D. Crowder
*Attorney, Agent, or Firm*—John P. Snyder

[57] ABSTRACT

A dragged suction dredger, comprising a suction pipe provided with a dragged suction head having a housing with a recessed suction nozzle and a cutting tool extending, in the cutting position, into the ground and being pivotally mounted on the housing and being held in the cutting position by holding mechanism which will deflect at the transgression of a predetermined load of the cutting tool, has the object to avoid loss of time during the dredging operations and inefficient dredging. For this purpose the holding mechanism comprise at least one fluid cylinder for pushing the cutting tool after a deflection back into the cutting position or into the holding position respectively, the fluid pressure of said fluid cylinder being subjected to the action of a gas cushion.

7 Claims, 4 Drawing Figures

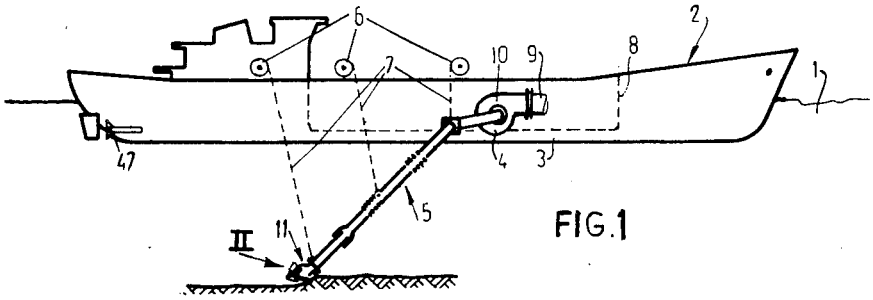
FIG.1
FIG.2
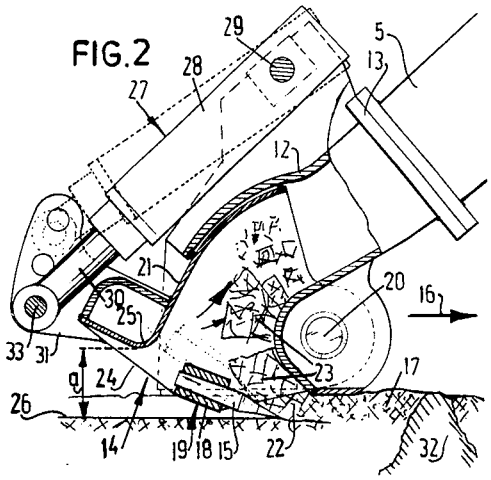
FIG. 4
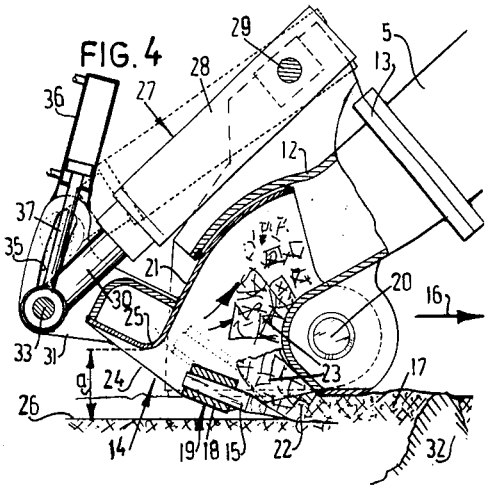
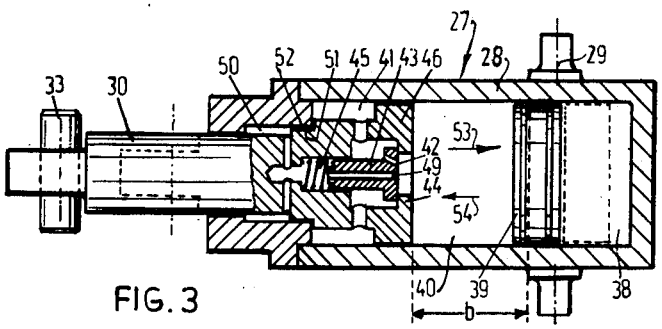
FIG. 3

SHOCK ABSORBING SYSTEM FOR SUCTION DREDGERS

The invention relates to a dragged suction dredger comprising at least one suction pipe provided with a dragged suction head having a housing in which at least one suction nozzle is recessed and a cutting tool extending into the ground in the cutting position and pivoted to the housing and held in the cutting position by holding means, which deflect at the transgression of a predetermined load of the cutting tool.

Such a dragged suction dredger is known from Dutch Pat. No. 13,035. With this known dragged suction dredger the holding means are formed by laths breaking down at a given load of the cutting tool in the event of an impact of the cutting tool on a heavy obstacle. In order to return the cutting tool into the cutting position, new laths have to be mounted, so that the dredging process has to be interrupted and the suction pipe with the dragged suction head has to be drawn out of the water. Moreover, the break-down of the laths will remain unperceived for some time, during which the dredging action is not efficient.

The invention has for its object to avoid loss of time during the dredging operations and inefficient dredging. For this purpose the holding means comprise at least one fluid cylinder for pushing the cutting tool after a deflection back into the cutting position or the holding position, the fluid pressure of said fluid cylinder being subjected to the action of a gas cushion.

It should be noted that from "Untersuchungen am Schleppsaugköpfen durch Nassbaggern" by W. Witt (1963), pages 4 and 5, FIGS. 3 and 5, there is known a dragged suction head having an adjustable visor, which is constantly kept in the lowermost position by the action of a gas cushion. From this publication it is not known to cause the cutting tool to move rapidly away from an obstacle stuck at a transgression of a predetermined load. By the same counter-pressure the cutting tool is constantly pressed against the ground. Tined parts of the dragged suction head connected with the remainder of the dragged suction head by heavy hinges are constantly kept in contact with the ground with the aid of a gas cushion despite slight angular displacements of the remainder of the dragged suction head with respect to the ground under water. Consequently, at the encounter of a hard part in the ground, for example, rock or the like the tines will be damaged.

From Dutch Pat. No. 113,155 there is known a dragged suction head comprising a movable dragged suction head portion, which is adjustable with respect to the dragged suction head by means of a lifting mechanism in order to cause the dragged suction head to operate effectively at different depths below the water level. The movable parts of this suction head do not comprise cutting tools that could be damaged.

A preferred embodiment of the dragged suction dredger in accordance with the invention is characterized in that the fluid cylinder comprises at least two chambers separated from one another by a piston displacing the fluid and communicating with one another through throttle means, which can be short-circuited by opening valve means at the input stroke of the piston.

The use of a gas cushion permits of pre-adjusting the level of forces of the holding means in dependence upon the ground material to be dredged up.

The invention will be described more fully hereinafter with reference to a drawing.

FIG. 1 is a side elevational view of a dragged suction dredger in accordance with the invention, FIG. 2 on an enlarged scale an elevation partly broken away of the detail II in FIG. 1, FIG. 3 an axial sectional view of a hydro-cylinder of detail II and FIG. 4 an elevational view like FIG. 2 of a different embodiment of the dragged suction dredger in accordance with the invention.

A dragged suction dredger 2 according to the invention floating on the water 1 comprises a floating body 3 having a driven propeller 47, at least one pump 4 mounted in the floating body 3, at least one flexible suction pipe 5 connected with the pump 4 and suspended by means of winches 6 and cables 7 to the floating body 3, a hold 8 communicating through a conduit 9 with the outlet 10 of the pump 4 and a dragged suction head 11 carried by the lower end of the suction pipe 5. The dragged suction head 11 according to the invention comprises a housing 12 connected with the suction pipe 5 and secured by a flange 13 to the lower end of the suction pipe 5. The housing 12 has a suction nozzle 14. The dragged suction head 11 comprises a cutting tool 19 formed by a beam 18 having tines 15 and extending transversely of the dragging direction 16, only one time being shown. The tines 15 extend into the ground 17 in the cutting position of the cutting tool 19. The cutting tool 19 is pivotally arranged on the housing 12, since it is secured to the visor 21 pivoted to the housing 12 by means of a shaft 20. The suction nozzle 14 in the bottom side of the housing 12 is divided by the cutting tool 19 virtually into two portions i.e. a suction nozzle portion 22, through which mainly the loosened ground 23 penetrates into the housing 12 and a suction nozzle portion 24, through which mainly water 1 is sucked up. The quantity of sucked-up water 1 depends upon the height *a*, over which the lower rim 25 of the visor 21 is adjusted above the cutting level 26 of the cutting tool 19. The visor 21 is held in a given position relative to the housing 12 by holding means 27 comprising a fluid cylinder 28 secured to the housing 12 so as to be pivotable about an axis 29, a piston rod 30 of which is pivoted to an ear 31 of the visor 21. The holding means 27 hold the cutting tool 19 in its cutting position, but at a transgression of a predetermined load of the cutting tool 19, for example, at the impact of the tines 15 on a rock 32, they will deflect. In order to set the height *a* prior to the beginning of the dredging operation as shown in FIG. 2, whilst the suction pipe 5 is lifted, the piston rod 30 is fastened by a pin 33 in a selected hole 34 with the ear 31, whilst as shown in FIG. 4, the pin 33 of the piston rod 30 is displaceable in a slot 35 of the ear 31 during the dredging operation with the aid of a hydraulic control-cylinder 36 actuated from the floating body 3 and fastened to the ear 31, the piston rod 37 of said cylinder being connected with the pin 33. In the adjusted position of the visor 21 the control-cylinder 36 is hydraulically firmly blocked.

The holding means 27 (see FIG. 3) comprise said fluid cylinder 28, whose fluid pressure depends upon a gas cushion 38, which is enclosed in the fluid cylinder 28 by an axially freely movable piston 39. A piston 46 displacing the fluid and connected with the piston rod 30 separates two fluid chambers 40 and 41 from one another. The fluid chambers 40 and 41 communicate with one another through throttle means formed by a throttle channel 49 and a very narrow throttle opening 42 of a valve body 43. During the input stroke *b* of the piston 46 in the direction of the arrow 53 the valve body 43 is lifted from its seat 44, the throttle means being then short-circuited. Owing to the penetration of the piston rod 30 in the fluid cylinder 28 during the stroke *b*, the fluid is displaced so that the gas cushion 38 is compressed through the floating piston 39. The difference in diameters of the piston rod 30 and the floating piston 39 ensures a rapid penetration at the beginning of the inward stroke so that the cutting tool is rapidly moved out of the reach of the obstacle. For this purpose the piston 46 is not damped during the stroke *b*. During the return stroke *b* in the direction of the arrow 54 the movements of the piston 46 and of the cutting tool 19 are, however, damped in order to prevent inertia forces from bringing the visor or the other movable portions of the dragged suction head so abruptly in contact with the gound that they might be damaged.

In the holding position shown in FIG. 3, for the holding means 27 the piston 46 is in an extreme position, in which the fluid chamber 41 is separated from the fluid chamber 50 by a fitting rim 51 co-operating with the lid 52 of the cylinder. Thus at the end of the return stroke the fluid chamber 41 communicates solely through the throttle opening 42 with the fluid chamber 40 so that the end of the return stroke *b* is additionally damped.

At an impact of the cutting tool 19 on a rock 32, it turns into the position indicated by broken lines in FIGS. 2 and 4, the holding means 27 then deflecting. During the inwardly stroke *b* of, for example, 45 cms, of the piston 46 the gas cushion 38, for example, nitrogen, is compressed from 45 to 150 ato. The force exerted by the holding means 27 on the ear 31 may then increase from 22 to 73 tons.

The gas cushion 38 pushes the holding means 27 back into the holding position and hence the cutting tool 19 back into its cutting position.

What I claim is:

1. In a suction dredger having a suction pipe provided with a suction head which is adapted to be dragged along the bottom beneath a body of water, said suction head including a cutting tool pivotally mounted for movement from a cutting position to an inoperative position in response to a predetermined force exerted against the cutting tool, the improvement which comprises: piston/cylinder means for allowing said cutting tool rapidly to swing to said inoperative position upon compression thereof and slowly to return to said cutting position upon extension thereof, said means comprising a cylinder, a piston slidably received in said cylinder, and a piston rod connected to said piston and projecting from said cylinder, said piston separating the interior of said cylinder into a first fluid chamber and a second fluid chamber on opposite sides of said piston, the second fluid chamber being on the piston rod side of said piston, gas cushion means in said first chamber normally maintaining fluid pressure sufficient to extend said piston/cylinder means, passage means restricting flow of fluid from said second chamber to said first chamber to restrict the rate of extension of said piston/cylinder means, and means for by-passing said passage means to allow substantially unrestricted passage of fluid from said first chamber to said second chamber as said piston/cylinder means is compressed.

2. In a suction dredger as defined in claim 1 wherein said gas cushion means comprises a free-floating piston in said cylinder forming a movable wall of said first chamber, and a quantity of gas trapped between said free-floating piston and one end of said cylinder, said free-floating piston being of substantially greater diameter than said piston rod to allow rapid compression of said piston/cylinder device.

3. In a suction dredger as defined in claim 2 wherein said means for by-passing comprises a check valve carried by said piston first mentioned.

4. In a suction dredger as defined in claim 3 wherein said passage means is formed in said check valve.

5. In a suction dredger having a suction pipe provided with a suction head adapted to be dragged over the bottom beneath a body of water, said suction head including a cutting tool pivotally mounted for movement from a cutting position to an inoperative position in response to predetermined force exerted on said cutting tool, the improvement which comprises:

a piston/cylinder device connected between said suction pipe and said cutting too, said device comprising a cylinder and a piston slidable therein, and a piston rod connected to said piston and projecting from said cylinder, said piston defining fluid chambers on opposite sides thereof, gas cushion means in said cylinder normally forcing said piston rod to extended position whereby the cutting tool is maintained in cutting position, passage means interconnecting said fluid chambers for restricting the rate of extended movement of said piston under the influence of said gas cushion means, and means for by-passing said passage means as the cutting tool is moved to the inoperative position.

6. In a suction dredger as defined in claim 5 wherein said gas cushion means comprises a free-floating piston in said cylinder and a quantity of gas trapped between said free-floating piston and one end of said cylinder, said free-floating piston being of substantially larger diameter than said piston rod to allow rapid movement of said piston rod in the compression direction when said means for by-passing is operative.

7. In a suction dredger as defined in claim 6 wherein said means for by-passing is a check valve and said passage means is formed in said check valve.

* * * * *